US009537219B2

(12) United States Patent
Ayala Vazquez et al.

(10) Patent No.: US 9,537,219 B2
(45) Date of Patent: Jan. 3, 2017

(54) ELECTRONIC DEVICE WITH PASSIVE ANTENNA RETUNING CIRCUITRY

(71) Applicant: Apple Inc., Cupertino, CA (US)

(72) Inventors: Enrique Ayala Vazquez, Watsonville, CA (US); Mattia Pascolini, San Franciso, CA (US); Hongfei Hu, Santa Clara, CA (US); Erdinc Irci, Santa Clara, CA (US); Yuehui Ouyang, Sunnyvale, CA (US); Jennifer M. Edwards, San Fancisco, CA (US); Jayesh Nath, Milpitas, CA (US); Salih Yarga, Sunnyvale, CA (US); Yijun Zhou, Sunnyvale, CA (US); Hao Xu, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 122 days.

(21) Appl. No.: 14/500,819

(22) Filed: Sep. 29, 2014

(65) Prior Publication Data

US 2016/0093955 A1 Mar. 31, 2016

(51) Int. Cl.

| | |
|---|---|
| ***H01Q 9/04*** | (2006.01) |
| ***H01Q 1/24*** | (2006.01) |
| ***H01Q 9/42*** | (2006.01) |
| ***H01Q 5/328*** | (2015.01) |
| ***H01Q 5/335*** | (2015.01) |

(52) U.S. Cl.

CPC ..... *H01Q 9/0442* (2013.01); *H01Q 1/243* (2013.01); *H01Q 5/328* (2015.01); *H01Q 5/335* (2015.01); *H01Q 9/42* (2013.01)

(58) Field of Classification Search

CPC ..... H01Q 9/0442; H01Q 5/328; H01Q 5/335; H01Q 1/243; H01Q 9/42

USPC ..... 343/702

See application file for complete search history.

(56) References Cited

U.S. PATENT DOCUMENTS

| | | | | |
|---|---|---|---|---|
| 3,739,390 | A * | 6/1973 | Poppe, Jr. | H01Q 21/30 343/729 |
| 6,085,071 | A * | 7/2000 | Yamada | H01P 1/213 333/126 |
| 8,872,706 | B2 | 10/2014 | Caballero et al. | |
| 9,059,505 | B1 * | 6/2015 | Asrani | H01Q 9/145 |
| 2003/0210203 | A1 * | 11/2003 | Phillips | H01Q 1/362 343/850 |
| 2005/0245204 | A1 * | 11/2005 | Vance | H01Q 1/243 455/80 |
| 2010/0321325 | A1 | 12/2010 | Springer et al. | |

(Continued)

*Primary Examiner* — Dameon E Levi
*Assistant Examiner* — David Lotter
(74) *Attorney, Agent, or Firm* — Treyz Law Group, P.C.; G. Victor Treyz; Michael H. Lyons

(57) ABSTRACT

An electronic device may have wireless circuitry with antennas. An antenna may have an inverted-F antenna resonating element, an antenna ground, and other resonating element structures. A tip of the antenna resonating element and the antenna ground may be separated by a peripheral housing gap filled with plastic. The antenna may be sensitive to capacitance changes induced by the presence of a user's hand overlapping the gap or other portions of the antenna. A hand capacitance sensing electrode may be mounted in the plastic of the gap or elsewhere in the vicinity of the antenna. A transmission line may couple the hand capacitance sensing electrode to the antenna to retune the antenna in the event that the user's hand overlaps the antenna.

22 Claims, 7 Drawing Sheets

(56) References Cited

U.S. PATENT DOCUMENTS

| | | | | |
|---|---|---|---|---|
| 2011/0136447 | A1* | 6/2011 | Pascolini | H01Q 1/243 455/90.2 |
| 2012/0231750 | A1 | 9/2012 | Jin et al. | |
| 2012/0299785 | A1* | 11/2012 | Bevelacqua | H01Q 9/42 343/702 |
| 2012/0329524 | A1 | 12/2012 | Kent et al. | |
| 2014/0179239 | A1 | 6/2014 | Nickel et al. | |

* cited by examiner

ELECTRONIC DEVICE WITH PASSIVE ANTENNA RETUNING CIRCUITRY

BACKGROUND

This relates generally to electronic devices and, more particularly, to electronic devices with antennas and other wireless circuitry.

Electronic devices often include wireless circuitry with antennas. For example, cellular telephones, computers, and other devices often contain antennas for supporting wireless communications.

It can be challenging to form electronic device antenna structures with desired attributes. In large electronic devices, antennas can sometimes be isolated from the surrounding environment. This makes the antennas relatively immune to environmental effects, but is not feasible in smaller devices. In a compact electronic device, antenna structures may be formed on or near the external surfaces of the device. This may make antenna performance subject to environmental influence. If, for example, a portion of an antenna is touched by a user's hand, the antenna can be detuned. Antenna detuning has the potential to adversely impact wireless communications performance.

It would therefore be desirable to be able to provide wireless circuitry and electrical components for electronic devices that exhibit enhanced immunity to environmental detuning.

SUMMARY

An electronic device may have wireless circuitry. The wireless circuitry may include a radio-frequency transceiver circuit coupled to one or more antennas. The electronic device may have a housing. Peripheral conductive housing structures in the housing may be used to form an inverted-F antenna resonating element and an antenna ground.

An antenna may be formed from the inverted-F antenna resonating element, the antenna ground, and other antenna structures. A tip of the antenna resonating element and the antenna ground may be separated by a peripheral housing gap filled with plastic. The antenna may be sensitive to capacitance changes induced by the presence of a user's hand overlapping the gap or other portions of the antenna. A hand capacitance sensing electrode may be mounted in the plastic of the gap or elsewhere in the vicinity of the antenna.

A transmission line may couple the radio-frequency transceiver circuit to the antenna. Another transmission line may couple the hand capacitance sensing electrode to the antenna to retune the antenna in the event that the user's hand overlaps the antenna.

DETAILED DESCRIPTION

Figure 1:
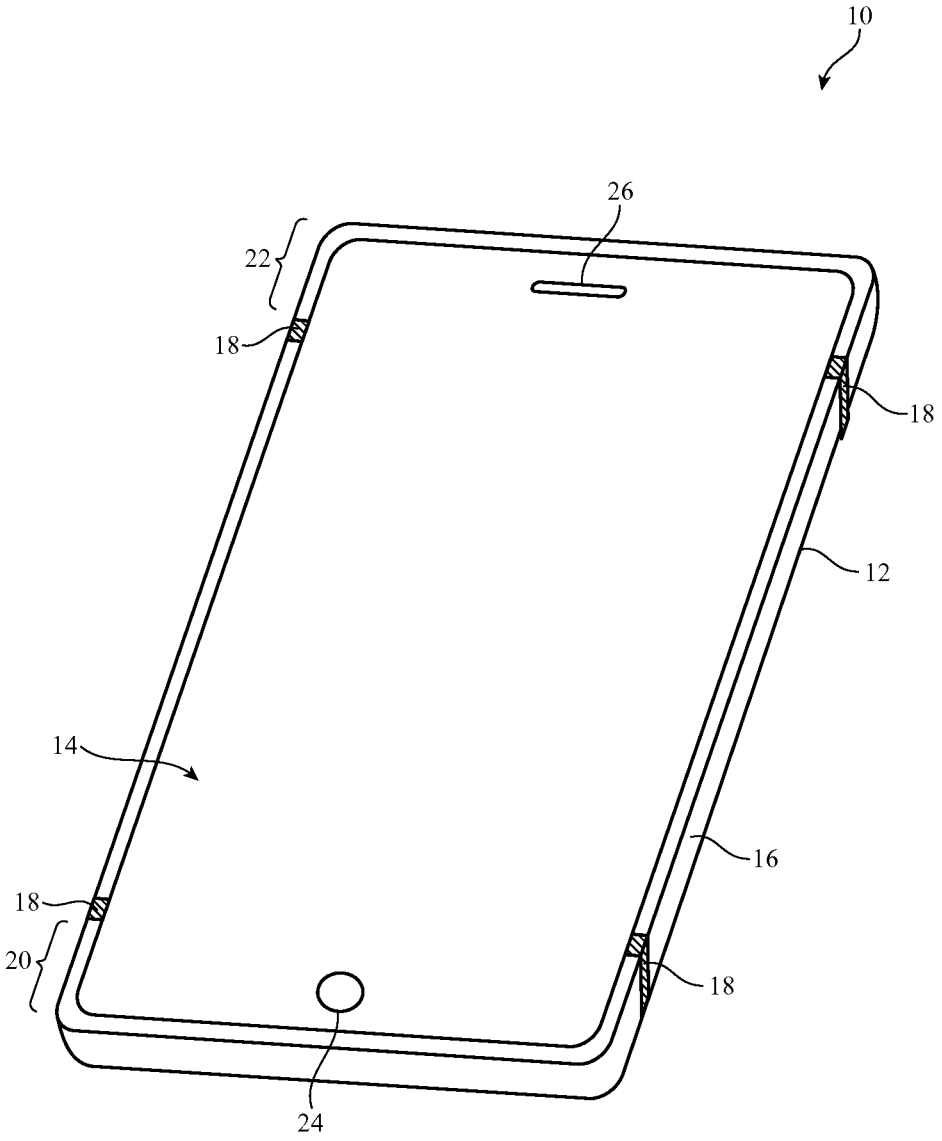
FIG. 1 is a perspective view of an illustrative electronic device in accordance with an embodiment.

Electronic devices such as electronic device 10 of FIG. 1 may be provided with electrical components and wireless communications circuitry. The wireless communications circuitry may include one or more antennas and may be used to support wireless communications in multiple wireless communications bands. Passive returning circuitry may be used to ensure that the antennas remain adequately tuned and performs as desired, even when users' hands or other external objects are adjacent to the antennas.

The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures. Gaps may be formed in the peripheral conductive structures that divide the peripheral conductive structures into peripheral segments. One or more of the segments may be used in forming one or more antennas for electronic device 10. Antennas may also be formed using an antenna ground plane formed from conductive housing structures such as metal housing midplate structures and other internal device structures. Rear housing wall structures may be used in forming antenna structures such as an antenna ground.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may be mounted on the front face of device 10. The rear face of device 10 may be formed from a planar rear housing wall in housing 12. Display 14 may be a touch screen that incorporates capacitive touch electrodes or may be insensitive to touch.

Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic may cover the surface of display 14. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalls that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as vertically extending integral metal portions of the planar metal structure. Housing structures such as these may, if desired, be machined from a block of metal and may include one or more separate pieces.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures, which may be used in forming a ground plane in device 10, may be located in the center of housing 12 (e.g., the portion of display 14 that contains a display module for displaying images and that lie between end regions 22 and 20).

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air, plastic, and other dielectrics.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under the active area of display 14 and/or other metal structures in device 10 may have portions that extend into parts of the ends of device 10 (e.g., the ground may extend towards the dielectric-filled openings in regions 20 and 22).

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with gap structures. For example, peripheral housing structures 16 may be provided with one or more gaps such as peripheral gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10. If desired, gaps may extend across the width of the rear wall of housing 12 and may penetrate through the rear wall of housing 12 to divide the rear wall into different portions. Polymer or other dielectric may fill these housing gaps (grooves).

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
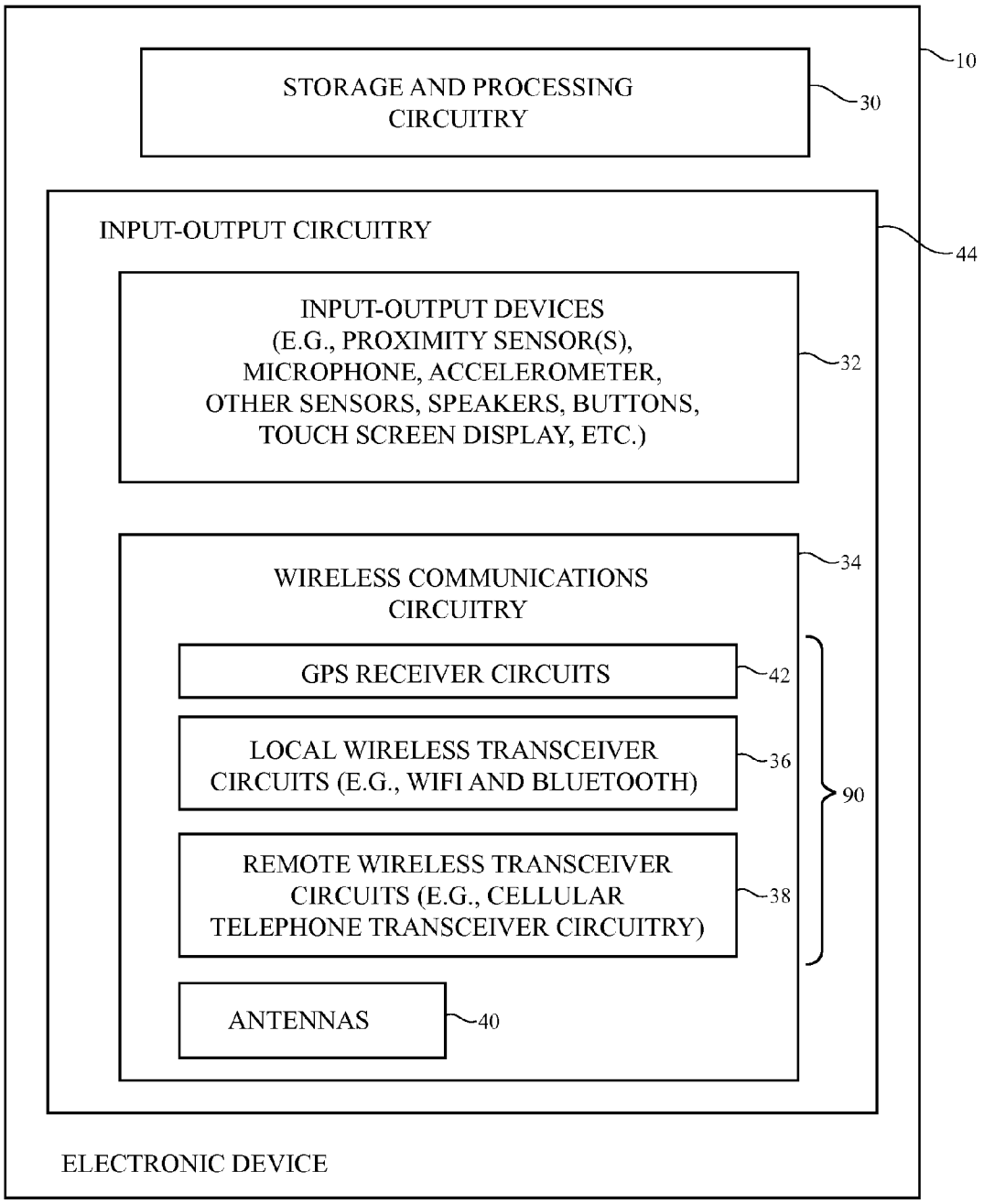
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, application specific integrated circuits, etc.

Storage and processing circuitry 30 may be used to run software on device 10, such as internet browsing applications, voice-over-internet-protocol (VOIP) telephone call applications, email applications, media playback applications, operating system functions, etc. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, fingerprint sensors (e.g., a fingerprint sensor integrated with a button such as button 24 of FIG. 1), etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
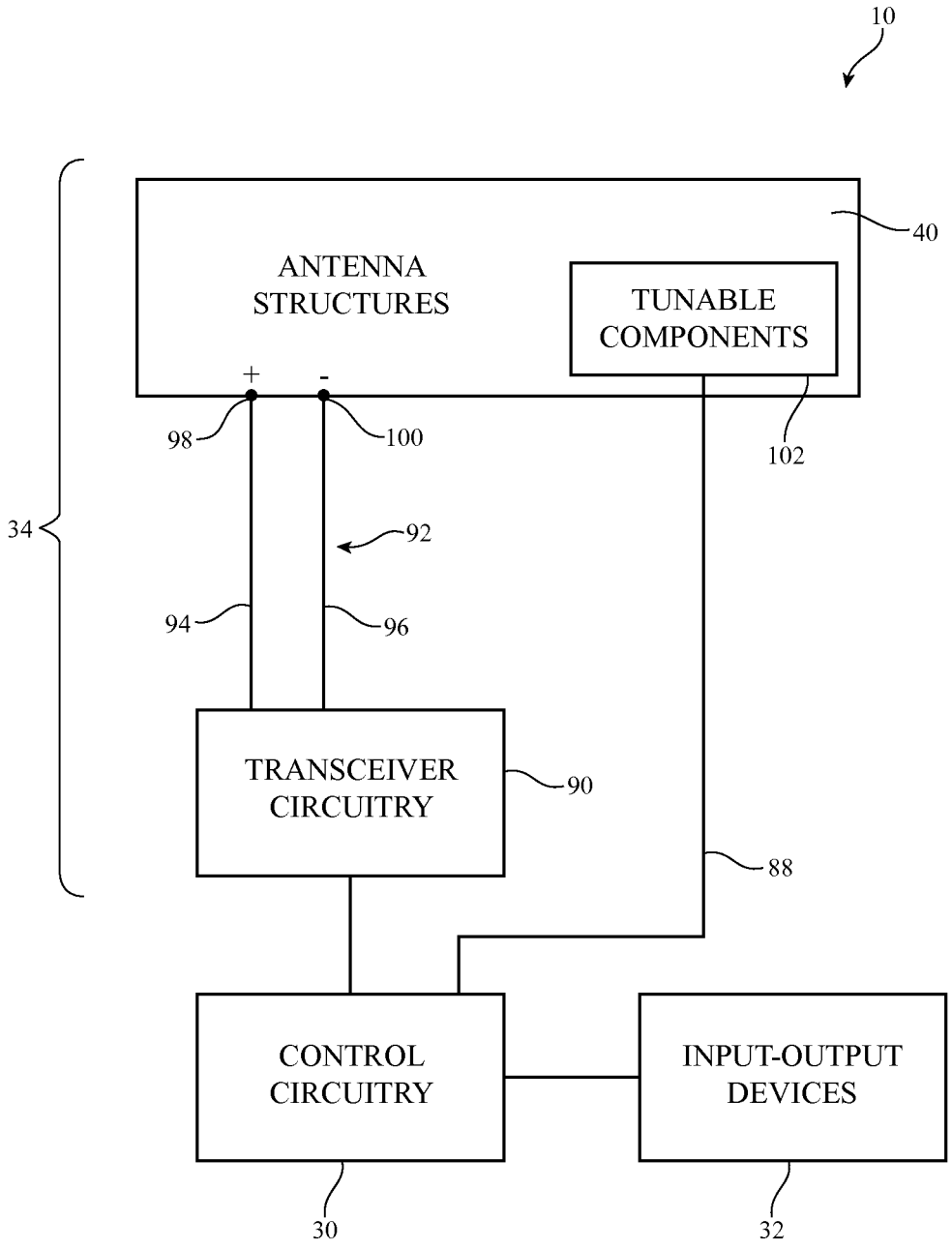
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as path 92. Wireless circuitry 34 may be coupled to control circuitry 30. Control circuitry 30 may be coupled to input-output devices 32. Input-output devices 32 may supply output from device 10 and may receive input from sources that are external to device 10.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna (s) 40 may be provided with adjustable circuits such as tunable components 102 to tune antennas over communications bands of interest. Tunable components 102 may be part of a tunable filter or tunable impedance matching network, may be part of an antenna resonating element, may span a gap between an antenna resonating element and antenna ground, etc. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 30 may issue control signals on one or more paths such as path 88 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna(s) 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 100. Other types of antenna feed arrangements may be used if desired. The illustrative feeding configuration of FIG. 3 is merely illustrative.

A directional coupler may be interposed in transmission line path 92. Control circuitry 30 and transceiver circuitry 90 may gather phase and magnitude information on the impedance of antenna 40 (or part of antenna 40) using the directional coupler. By using the coupler or other circuitry to gather real time information on the impedance of antenna 40, control circuitry 30 can determine when antenna 40 is being loaded by external objects (e.g., when a user's hand is in the vicinity of antenna 40 and is therefore affecting the impedance of antenna 40). If desired, control circuitry 30 may use information from a proximity sensor (see. e.g., sensors 32 of FIG. 2), received signal strength information, or other information in determining when antenna 40 is being affected by the presence of nearby external objects. In response to detecting that a user's hand or other external object is adjacent to antenna 40, control circuitry 30 may take corrective action. For example, control circuitry 30 can issue commands to adjustable circuitry such as tunable components 102 of FIG. 3 or other tunable circuitry that affects the operation of antenna 40.

Passive retuning circuitry may also be provided in device 10 to help prevent antenna 40 from being detuned due to the presence of an external object such as a user's hand or other body part. In a passive retuning arrangement, a capacitance change or other change that is produced by the user's hand (or other external object) is used to adjust antenna 40 in a way that prevents antenna 40 from exhibiting undesired detuning effects. By using passive retuning structures, the need to implement active tuning control for components 102 may be reduced or may even be eliminated (if desired).

Figure 4:
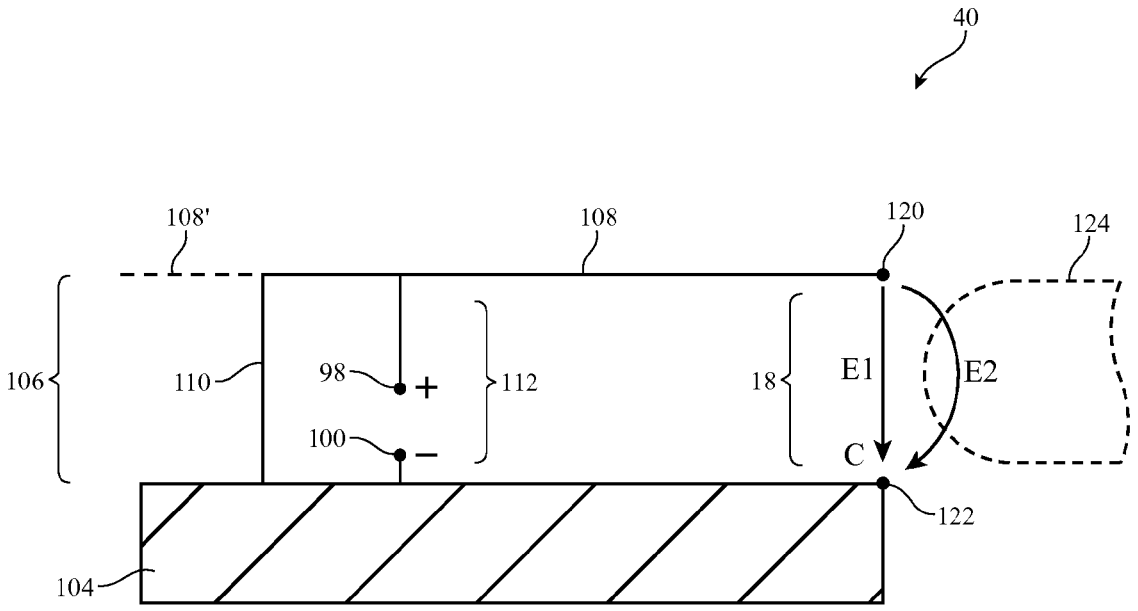
FIG. 4 is a schematic diagram of an illustrative inverted-F antenna showing how the antenna may be influenced by the presence of a user's body or other external object in accordance with an embodiment.

The potential of an external object to influence antenna performance is illustrated in connection with the illustrative antenna of FIG. 4. FIG. 4 is a diagram of illustrative inverted-F antenna structures that may be used in implementing antenna 40 for device 10. Other types of antenna (e.g., slot antennas, hybrid inverted-F slot antennas, etc.) may be used in forming antenna 40 if desired.

As shown in FIG. 4, inverted-F antenna 40 may have antenna resonating element 106 and antenna ground (ground plane) 104. Antenna resonating element 106 may have a main resonating element arm such as arm 108. The length of arm 108 and/or portions of arm 108 may be selected so that antenna 40 resonates at desired operating frequencies. For example, the length of arm 108 or a portion of arm 108 may be a quarter of a wavelength at a desired operating frequency for antenna 40. Antenna 40 may also exhibit resonances at harmonic frequencies. As illustrated by illustrative resonating element arm branch 108', resonating element arm 108 may have two or more branches. For example, arm 108 may have a longer portion that extends to the right (in FIG. 4) and that handles lower frequency communications and may have a shorter portion (see, e.g., branch portion 108' of arm 108) that extends to the left (in FIG. 4) and that handles higher frequency communications. If desired, additional structures may be combined with the antenna structures of FIG. 4 so that antenna 40 covers communications bands of interest. For example, a slot antenna resonating element may be added to antenna 40 that supports antenna operation in a higher frequency band than that covered using the longer and shorter portions of arm 108.

Main resonating element arm 108 may be coupled to ground 104 by return path 110. Antenna feed 112 may include positive antenna feed terminal 98 and ground antenna feed terminal 100 and may run in parallel to return path 110 between arm 108 and ground 104. The antenna feed for antenna 40 may include positive antenna feed terminal 98 and ground antenna feed terminal 100.

Antenna 40 may be implemented using conductive structures in device 10 such as conductive housing structures, metal traces on a plastic carrier or printed circuit, etc. With one suitable arrangement, arm 108 and/or portions of ground 104 may be formed from peripheral conductive housing structures 16. Gap 18 may separate tip portion 120 of arm 108 from nearby portion 122 of ground 104 (and a corresponding gap 18 on an opposing side of device 10 may separate the tip of branch 108' of arm 108 from a corresponding adjacent portion of ground 104).

Resonating element arm portion 120 and antenna ground portion 122 form electrodes in a capacitor (i.e., gap 18 is associated with a capacitance C). The value of the capacitance between portion 120 and portion 122 is influenced by the operating environment of antenna 40. In particular, the value of capacitance C associated with gap 18 may be influenced by whether or not an external object such as user hand 124 is adjacent to gap 18 of antenna 40. Electric fields such as electric fields E1 and E2 may develop between portions 120 and 122. The change in capacitance C results from the varying environments of the electric fields between portions 120 and 122. In some situations such as the illustrative scenario shown in FIG. 4, some of these electric fields (see, e.g., field E2) may pass through external object 124 (e.g., a user's hand), whereas in other scenarios, electric fields pass through air. The dielectric constant of flesh is greater than the dielectric constant of air, so the value of C will rise in the presence of an external object such as a user's hand and will fall in the presence of air (i.e., in the absence of the hand). Unless care is taken, fluctuations in the value of capacitance C may have an undesired impact on antenna performance.

The location of the portion of antenna 40 that experiences a change in capacitance or other impedance change due to the presence of a user's hand in the vicinity of antenna 40 affects the results of the capacitance change. In an inverted-F antenna of the type shown in FIG. 4, for example, an increase in capacitance C at the tip of arm 108 between portions 120 and 122 will tend to reduce antenna efficiency and will tend to shift the antenna resonance associated with arm 108 (e.g., a low band resonance) to lower frequencies. The shift of the low band to lower frequencies and the decrease in antenna efficiency associated with the operation of antenna 40 may disrupt desired antenna operation (e.g., communications in a low band frequency range may be disrupted). If, on the other hand, capacitance increases at feed 112 of antenna 40, the frequency of the low band resonance may be increased or at least maintained at a constant value. Antenna efficiency may also improve or at least may not decrease when the capacitance at the feed is increased.

To help passively counteract the undesired effects of increasing capacitance C between portions 120 and 122 due to contact between a user's hand and antenna 40 in the vicinity of gap 18, a transmission line may be used to transfer the influence of the presence of the user's hand from the vicinity of gap 18 or other suitable location on device 10 to the vicinity of feed 112. The transmission line may be, for example, a coaxial cable transmission line, a microstrip transmission line, or other transmission line. An electrode may be used to register the presence of the user's hand. When the user's hand touches the electrode, a rise in capacitance is produced. This rise in capacitance is transferred to feed 112 to counteract the expected detuning influence of hand 124 in the vicinity of gap 18 at the tip of arm 108.

Figure 5:
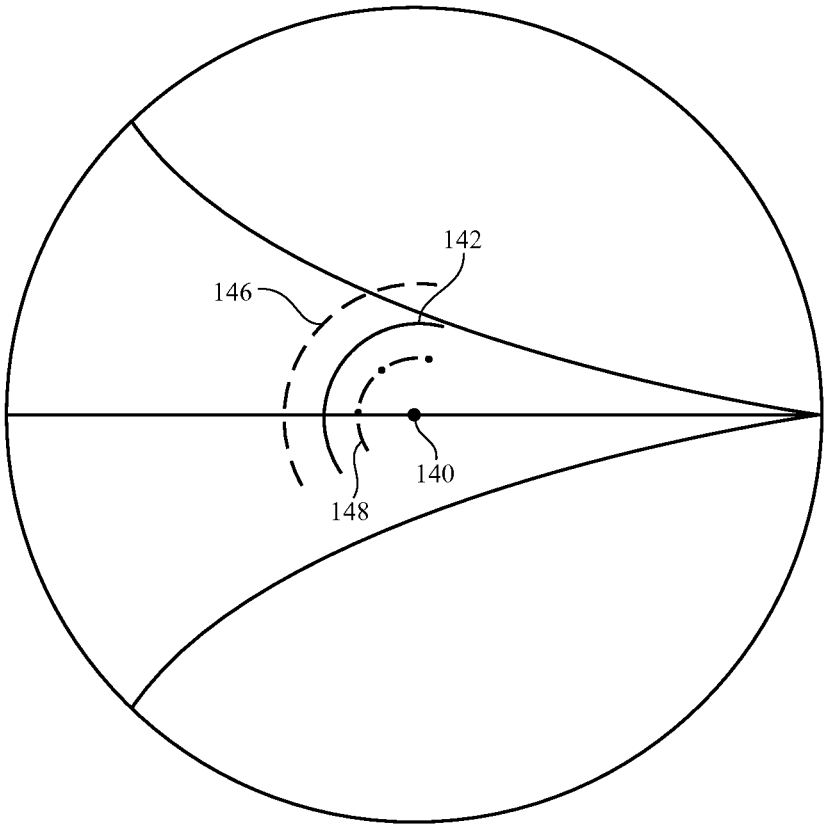
FIG. 5 is a Smith chart showing illustrative impedances associated with operation of an antenna in accordance with an embodiment.

Consider, as an example, the illustrative impedances for antenna 40 that are plotted in FIG. 5. FIG. 5 is a Smith chart illustrating the impact of using a coaxial cable or other circuitry to transfer capacitance increases (or other impedance changes) from an electrode that is contacted by the user's hand to a portion of antenna 40 where the capacitance increase will help improve antenna performance (e.g., feed 112).

In the Smith chart of FIG. 5, transmission line 92 may have an impedance of 50 ohms (as an example), as illustrated by impedance 140. When antenna 40 is operating normally (across a range of frequencies between 700 MHz and 2700 MHz or other frequency range), antenna 40 may exhibit an impedance such as illustrative impedance 142. Impedance 142 may be associated with the use of device 10 in free space. In this configuration, tip 120 and portion 122 of ground 104 serve as capacitor electrodes for a capacitor of capacitance C at the tip of arm 108. Because of the absence of the user's hand, antenna 40 will operate normally (i.e., antenna impedance 142 will be sufficiently matched to transmission line impedance 140 to allow antenna 40 to function as desired).

If the user's hand or other external object is placed in the presence of gap(s) 18 (i.e., adjacent to antenna 40), antenna impedance 142 has the potential be detuned to impedance 146 (e.g., a value that is at mismatched with respect to transmission line impedance 140 and which therefore may cause antenna 40 to operate with unsatisfactory performance).

To prevent this detuning from adversely affecting antenna operation, antenna 40 may be passively retuned. In particular, an electrode may be provided near the external surface of device 10 in the vicinity of antenna 40 (e.g., near gap 18). Impedance changes in the vicinity of this electrode due to the presence of the user's hand may be conveyed to a suitable location in antenna 40 such as antenna feed 112 by a transmission line to counteract the potential antenna detuning associated with impedance 146. As shown in FIG. 5, for example, antenna 40 may exhibit satisfactory impedance 148 in the presence of passive retuning. Impedance 148 may be as well matched to transmission line impedance 140 as impedance 142 or may (as shown in FIG. 5) be more closely matched to impedance 140 than free space impedance 142. Configurations in which passive antenna retuning is used to make antenna detuning from hand contact less severe than the detuning associated with detuned impedance 146 but that do not completely eliminate detuning effects may also be used.

Figure 6:
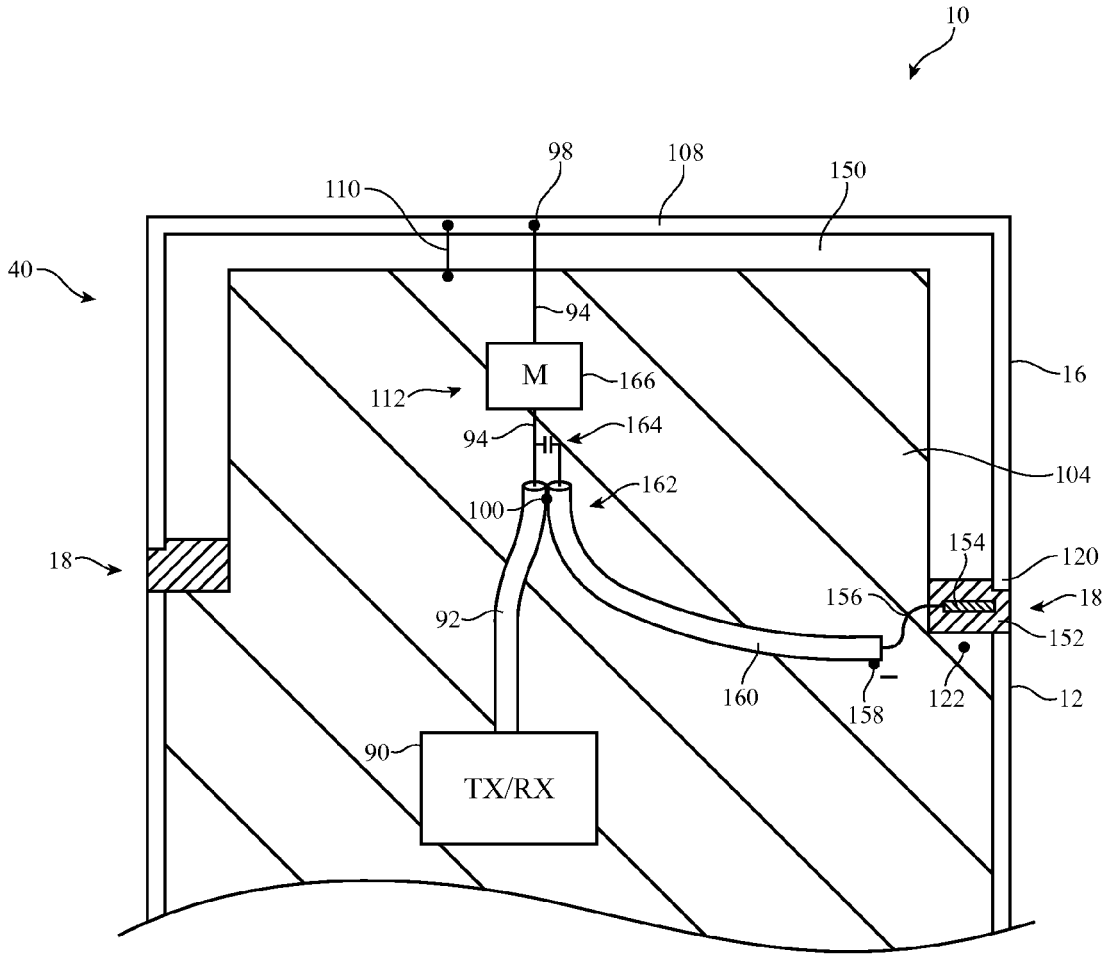
FIG. 6 is a top interior view of an illustrative electronic device with a passively retuned antenna in accordance with an embodiment.

FIG. 6 is a top interior view of device 10 in an illustrative configuration in which passive antenna retuning is being used for antenna 40. As shown in FIG. 6, antenna 40 may include an inverted-F antenna resonating element formed from peripheral conductive housing structures such as inverted-F antenna resonating element 108. Resonating element 108 may be separated from antenna ground 104 by opening 150. Opening 150 may be filled with dielectric such as air and/or plastic. The shape of opening 150 may be selected to form a slot antenna resonating element. Antenna resonating element 108 may be a two-branch inverted-F antenna resonating element that resonates in first and second communications bands (e.g., a low band and a middle band) and slot 105 may be a slot antenna resonating element that contributes an antenna resonance in a high band (as an example). Return path 110 may couple resonating element 108 to ground 104 and may bridge slot 150. Feed 112 may be formed in parallel with return path 110.

Transceiver circuitry 90 may be coupled to antenna feed terminals 98 and 100 using transmission line 92. Impedance matching circuit 166 may be coupled between terminals 98 and 100 to help match the impedance of transmission line 92 to the impedance of antenna 40. Gaps 18 in the peripheral conductive housing structures of housing 12 may separate the ends of inverted-F antenna resonating element 108 from grounded portions of housing 12 (i.e., antenna ground). Gaps 18 may be filled with polymer or other dielectric. For example, right-hand gap 18 of FIG. 6 may be filled with plastic 152.

An electrode such as electrode 154 may be located on or near the external surface of antenna 40 in the vicinity of gap 18 or may be mounted in device 10 in another location that allows electrode 154 to sense capacitance changes associated with the presence and absence of the user's hand or other external object. In the example of FIG. 6, electrode 154 has been embedded within plastic 152 in peripheral gap 18. This is merely illustrative. Electrode 154 may be mounted in device 10 using any suitable mounting arrangement. Because electrode 154 senses capacitance changes associated with the presence or absence of a user's hand or other external object, electrode 154 may sometimes be referred to as a hand capacitance sensing electrode.

A transmission line such as coaxial cable 160 may be coupled between electrode 154 and feed 112. Cable 160 may have a positive inner conductor such as center conductor 156 that is coupled to electrode 154 and may have an outer ground conductor that is shorted to ground 104 at node 158. At end 162 of cable 160, center conductor 156 may be coupled to center conductor 94 of coaxial cable 92 (or other transmission line) through capacitor 164 or other coupling circuitry. The outer ground conductor of cable 160 at end 162 may be coupled to ground antenna feed terminal 100. Positive antenna feed terminal 98 in feed 112 may be coupled to resonating element 108 (e.g., the segment of peripheral conductive housing structure that stretches between the left-hand and right-hand peripheral gaps 18 of FIG. 6).

Figure 7:
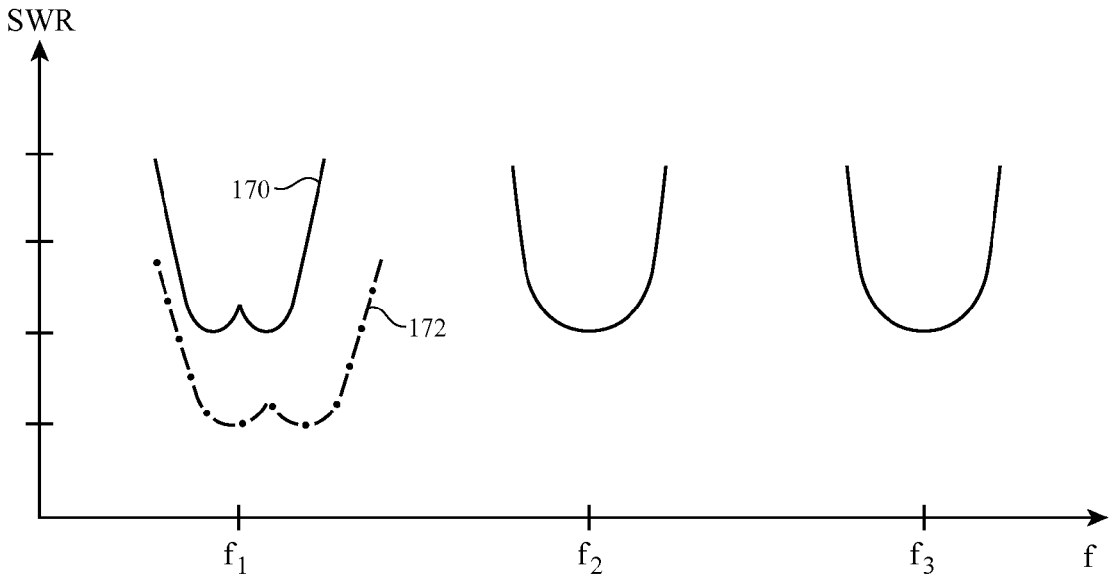
FIG. 7 is a diagram in which antenna performance (standing wave ratio) has been plotted as a function of frequency during free-space operation and when loaded by an external object in accordance with an embodiment.

The response of antenna 40 when device 10 is held in the hand of a user is shown in FIG. 7. In the graph of FIG. 7, antenna performance for antenna 40 (e.g., standing wave ratio SWR) has been plotted as a function of operating frequency f. As shown in FIG. 7, antenna 40 operates in a low band at frequency f1, a midband at frequency f2, and a high band at frequency f3. Low band operation is most influenced by the presence or absence of contact between the user's hand and device 10 (e.g., hand contact overlapping gap 18 of antenna 40, etc.). In free space, low band performance of antenna 40 may be characterized by curve 170. When a user holds device 10, there is a potential for the user's hand to load antenna 40 and thereby detune antenna 40, as described in connection with FIG. 4. Due to the presence of electrode 154, however, the capacitance rise or other impedance change that is produced when the user's hand overlaps gap 18, is conveyed from electrode 154 to feed 112 by cable 160. As a result, antenna performance improves rather than being adversely affected by the presence of the user's hand. Antenna 40 is effectively retuned and detuning is prevented as shown by curve 172 (FIG. 7). The ability of the configuration of FIG. 6 to convey the increase in capacitance (or other effects) due to the user's hand from hand capacitance sensing electrode 154 to antenna feed 112 and thereby retune the antenna allows device 10 to maintain a desired level of antenna performance or to improve antenna performance when the user's hand is adjacent to antenna 40 (i.e., gap 18 and electrode 154).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:
an antenna having an antenna feed;
a transceiver circuit coupled to the antenna;
a hand capacitance sensing electrode;
a radio-frequency transmission line that couples the hand capacitance sensing electrode to the antenna; and
a capacitor coupled between the radio-frequency transmission line and the antenna feed.

2. The electronic device defined in claim 1 wherein the antenna feed is coupled to a first end of the radio-frequency transmission line and wherein the hand capacitance sensing electrode is coupled to an opposing second end of the radio-frequency transmission line.

3. The electronic device defined in claim 2 wherein the antenna comprises:
an inverted-F antenna resonating element; and
an antenna ground, wherein a tip portion of the inverted-F antenna resonating element is separated from the antenna ground by a gap.

4. The electronic device defined in claim 3 further comprising:
a housing, wherein the gap is formed on a peripheral edge of the housing.

5. The electronic device defined in claim 4 wherein the hand capacitance sensing electrode is located at the gap.

6. The electronic device defined in claim 5 wherein the gap is filled with plastic and wherein the electrode is embedded within the plastic.

7. The electronic device defined in claim 6 wherein the housing has peripheral conductive housing structures and wherein the inverted-F antenna resonating element is formed from the peripheral conductive housing structures.

8. The electronic device defined in claim 1 wherein the radio-frequency transmission line has an inner conductor and an outer conductor and wherein the capacitor is coupled between the inner conductor and an inner conductor of an additional radio-frequency transmission line that is coupled between the transceiver circuit and the antenna.

9. The electronic device defined in claim 1 further comprising:
a housing having first and second ends, wherein the antenna is located at the first end.

10. The electronic device defined in claim 9 wherein the antenna comprises:
an inverted-F antenna resonating element; and
an antenna ground.

11. The electronic device defined in claim 10 wherein the inverted-F antenna resonating element has a resonating element arm formed from peripheral conductive housing structures in the housing.

12. The electronic device defined in claim 11 wherein a tip portion of the inverted-F antenna resonating element is separated from the antenna ground by a gap.

13. The electronic device defined in claim 12 wherein the hand capacitance sensing electrode is mounted at the gap.

14. The electronic device defined in claim 1 further comprising:
a metal housing, wherein the antenna comprises an antenna resonating element formed from at least part of the metal housing and an antenna ground formed from at least part of the metal housing.

15. The electronic device defined in claim 14 wherein the metal housing has peripheral conductive structures, wherein a gap separates the peripheral conductive structures from the antenna ground, wherein the hand capacitance sensing electrode is mounted adjacent to the gap and detects a capacitance change when a hand covers the gap, and wherein the capacitance change is conveyed to the antenna by the radio-frequency transmission line to retune the antenna and maintain antenna performance while the hand covers the gap.

16. An electronic device that is configured to be held in a hand of a user, comprising:
an antenna;
a radio-frequency transceiver circuit;
a hand capacitance sensing electrode that is not grounded along its length;
a first radio-frequency transmission line that couples the radio-frequency transceiver circuit to the antenna; and
a second radio-frequency transmission line that couples the hand capacitance sensing electrode to the antenna.

17. The electronic device defined in claim 16 further comprising a housing having an exterior surface, wherein the hand capacitance sensing electrode is mounted adjacent to the exterior surface and senses capacitance changes due to presence and absence of the hand of the user overlapping a given part of the antenna.

18. The electronic device defined in claim 17 wherein the capacitance changes are conveyed to a feed of the antenna by the second radio-frequency transmission line to retune the antenna when the hand of the user is present adjacent to the given part of the antenna.

19. An electronic device, comprising:

peripheral conductive housing structures that extend around a periphery of the electronic device, wherein a gap is formed in the peripheral conductive housing structures at the periphery of the electronic device, and the gap is filled with dielectric;

an antenna that is sensitive to detuning from contact by a user's hand; and an electrode that is coupled to the antenna by a conductor in a radio-frequency transmission line, wherein contact with the electrode changes a capacitance at the antenna that compensates for the detuning and the electrode is at least partially embedded within the dielectric at the gap.

20. The electronic device defined in claim 19 further comprising:

an additional radio-frequency transmission line; and a radio-frequency transceiver that is coupled to the antenna by the additional radio-frequency transmission line, wherein the additional radio-frequency transmission line has a signal line that is coupled to the conductor in the radio-frequency transmission line.

21. The electronic device defined in claim 1 wherein the radio-frequency transmission line is coupled between the antenna feed and the hand capacitance sensing electrode.

22. The electronic device defined in claim 21, wherein the radio-frequency transmission line is directly connected to the hand capacitance sensing electrode.

* * * * *